US007310073B2

(12) United States Patent
Park et al.

(10) Patent No.: US 7,310,073 B2
(45) Date of Patent: Dec. 18, 2007

(54) PLASMA DISPLAY PANEL

(75) Inventors: Jae Bum Park, Seongnam-si (KR); Sung Chun Choi, Anyang-si (KR)

(73) Assignee: LG Electronics Inc., Seoul (KR)

( * ) Notice: Subject to any disclaimer, the term of this patent is extended or adjusted under 35 U.S.C. 154(b) by 644 days.

(21) Appl. No.: 10/929,378

(22) Filed: Aug. 31, 2004

(65) Prior Publication Data

US 2005/0057142 A1 Mar. 17, 2005

(30) Foreign Application Priority Data

Sep. 1, 2003 (KR) ..... 10-2003-0060885
May 7, 2004 (KR) ..... 10-2004-0032393
Jun. 3, 2004 (KR) ..... 10-2004-0040548

(51) Int. Cl.
*H01J 17/49* (2006.01)

(52) U.S. Cl. ..... 345/41; 345/42; 345/60; 345/63; 345/67; 313/497; 313/582; 313/587; 313/609

(58) Field of Classification Search ..... 345/41, 345/42, 48, 55, 60, 63, 67; 313/485, 496, 313/497, 582, 609
See application file for complete search history.

(56) References Cited

U.S. PATENT DOCUMENTS 6,586,879 B1 * 7/2003 Shino et al. ..... 313/582
2002/0067127 A1 * 6/2002 Makino ..... 313/582
2002/0140341 A1 * 10/2002 Nishio ..... 313/491
2003/0042855 A1 * 3/2003 Chien et al. ..... 313/586
2003/0173900 A1 * 9/2003 Inan et al. ..... 313/587

* cited by examiner

*Primary Examiner*—Bipin Shalwala
*Assistant Examiner*—Vincent E. Kovalick
(74) *Attorney, Agent, or Firm*—Ked & Associates, LLP

(57) ABSTRACT

The present invention relates to a plasma display panel, and more particularly, to an electrode structure of a plasma display panel capable of improving brightness and efficiency. According to a first embodiment of the present invention, in a plasma display panel of a long column structure having a front substrate and a rear substrate that are opposite to each other, the transparent electrodes of the scan electrodes or the sustain electrodes include projections projected toward the center of the discharge cells every discharge cell. Also, a discharge start voltage and a discharge sustain voltage can be lowered and brightness and efficiency can be increased. It is also possible to maintain color temperature equilibrium every RGB cell and to reduce an erroneous discharge of each cell.

15 Claims, 12 Drawing Sheets

| Electrode structure | Discharge start voltage (V) | Brightness (cd/m2) | Number of charges (#) | Current consumed (mA) |
|---|---|---|---|---|
| Existing structure | 373.2 | 3533.4 | 6.45E+07 | 0.501 |
| Improved structure (80x60) | 312.9 | 4014.1 | 9.98E+07 | 0.890 |
| Improved structure (40x60) | 344.0 | 3875.5 | 8.47E+07 | 0.714 |

PLASMA DISPLAY PANEL

This Nonprovisional application claims priority under 35 U.S.C. § 119(a) on Patent Application No. 10-2003-0060885 filed in Korea on Sep. 1, 2003, Application No. 10-2004-0032393 filed in Korea on May 7, 2004 and Application No. 10-2004-0040548 filed in Korea on Jun. 3, 2004, the entire contents of which are hereby incorporated by reference.

BACKGROUND OF THE INVENTION

1. Field of the Invention

The present invention relates to a plasma display panel, and more particularly, to an electrode structure of a plasma display panel capable of improving brightness and efficiency.

2. Description of the Background Art

Generally, in a plasma display panel (hereinafter, referred to as 'PDP'), barrier ribs formed between a front glass and a rear glass made of soda lime glass constitute a single unit cell. When an inert gas having a small amount of xenon (Xe) added thereto is discharged by a high frequency voltage using neon (Ne), helium (He) or a mixed gas (Ne+He) of Ne and He as a main discharge gas, vacuum ultraviolet rays are generated to radiate a phosphor material formed between the barrier ribs, thus implementing an image.

Such a PDP is an image display device using a plasma discharge of an inert gas in a minute space of 0.1 mm to 1 mm in length compared to the cathode ray tube (CRT) that was a main kind of a conventional display means. The PDP has characteristics that its manufacturing is easy due to simple structure and a wide screen is possible due to a thin exterior and low power consumption. Accordingly, the PDP has been spotlighted as a next-generation display device.

In case of a PDP that has been usually used, power versus luminous efficiency is 1 to 1.5 lm/W. On the contrary, in case of a sample PDP for test, power versus luminous efficiency is 2.0~3.0 lm/W. The reason why the luminous efficiency in the test sample is higher than the luminous efficiency of the PDP that is usually used is not due to structural improvement but that the amount of Xe within a gas injected into the discharge space is added more about 14% than an average amount.

If the amount of Xe added increases, power versus luminous efficiency can also increases. However, there are adverse effects in that abrasion of a front panel electrode increases and a sustain voltage for maintaining a discharge increases. Also, even in driving the panel, a cooling effect of electrons increases due to the increased amount of Xe. Thus, a time delay phenomenon that the start of a discharge is delayed occurs.

FIG. 1 shows an electrode structure of a front substrate in a conventional plasma display panel having a long column structure.

Referring to FIG. 1, the front substrate of the conventional long column structure PDP includes discharge cells demarcated by barrier ribs 300, and a scan electrode 210 and a sustain electrode 220 each of which has a transparent electrode 200 and a metal electrode 100. In FIG. 1, reference numeral 10 indicates a distance between the transparent electrodes 200 and 400 schematically shows that a discharge is generated.

In the PDP of the long column structure, a phosphor material is excited by a gas discharge in a negative glow region, radiating light and a discharge is performed utilizing a positive column region in which an excitation characteristic of Xe is high.

If a PDP has a discharge period in which a distance 10 between the transparent electrodes 200 is 300 μm, there exists a positive column region between the transparent electrodes.

Power versus luminous efficiency in the negative glow region is 1 to 2 lm/W, whereas power versus luminous efficiency in a discharge utilizing the positive column region is 7 lm/W or more. Therefore, in order to expand such positive column region, the distance 10 between the transparent electrodes 200 is made 300 um or more.

FIGS. 2, 3 and 4 are views shown to explain the principle of discharge start and discharge sustain in the plasma display panel having the long column structure.

Referring to FIG. 2, negative charges are accumulated in the scan electrode 210 and positive charges are accumulated in the address electrode 230, by means of a reset waveform applied to the electrode when the PDP is driven. Thereafter, if a negative voltage is applied to the scan electrode 210, the distance 10 between the transparent electrodes 200 of an upper plate becomes greater than a distance 20 between the upper plate and the lower plate. Therefore, a weak discharge 600 occurs between the scan electrode 210 of the upper plate and the address electrode 230 of the lower plate.

By reference to FIG. 3, electrons are diffused toward the sustain electrode 220 by means of a potential difference between the scan electrode 210 and the sustain electrode 220, thereby forming a positive column region 700. A negative glow 710 discharge region formed by an initial discharge is located between the scan electrode 210 of the upper plate and an address electrode 230 of the lower plate. The positive column region 700 is maximized and expanded to the sustain electrode 220.

In case of the plasma display panel of the above long column structure, however, luminous efficiency can be increased, whereas a distance between transparent electrodes in the panel becomes 300 μm or more. Therefore, there are problems in that a voltage for maintaining a discharge of a discharge space increases and a discharge start voltage rises.

Furthermore, in a common PDP, the amount of voltages applied to RGB cells in order to maintain the same color temperature can be different because brightness characteristics of RGB phosphor materials are different. In this case, there is a problem in that overall driving efficiency is lowered since an erroneous discharge occurs in the RGB cells.

SUMMARY OF THE INVENTION

Accordingly, an object of the present invention is to solve at least the problems and disadvantages of the background art.

An object of the present invention is to provide a plasma display panel of a long column structure in which a discharge start voltage and a discharge sustain voltage is lowered, and brightness and efficiency are increased.

Another object of the present invention is to provide a plasma display panel of a long column structure in which color temperature equilibrium is maintained every RGB cell and an erroneous discharge in each cell is reduced.

To achieve the above objects, according to a first embodiment of the present invention, there is provided a plasma display panel having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein the transparent electrodes of the scan electrodes or the sustain electrodes include projections projected toward the center of the discharge cells every discharge cell.

To achieve the above objects, according to a second embodiment of the present invention, there is provided a plasma display panel having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein the transparent electrodes of the scan electrodes or the sustain electrodes include projections projected toward the center of the discharge cells in at least one of the discharge cells, and the projections are different in shape from each other every red cell, green cell and blue cell.

To achieve the above objects, according to a third embodiment of the present invention, there is provided a plasma display panel having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein floating transparent electrodes are formed in the front substrate between the scan electrodes and the sustain electrodes.

According to the present invention, in a plasma display panel of a long column structure, it is possible lower a discharge start voltage and a discharge sustain voltage and to increase brightness and efficiency. Furthermore, color temperature equilibrium can be maintained every RGB cell and an erroneous discharge in each cell can be reduced.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

First Embodiment

A plasma display panel according to a first embodiment of the present invention includes a front substrate and a rear substrate that are opposite to each other, wherein the plasma display panel includes scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, wherein a distance between the scan electrodes and the sustain electrodes is greater than that between the front substrate and the rear substrate, wherein the transparent electrodes of the scan electrodes or the sustain electrodes include projections projected toward the center of the discharge cells every discharge cell.

Further, the projections have various shapes such as square, rectangle and triangle.

Also, the projections of the transparent electrodes of the scan electrodes are different in shape from those of the transparent electrodes of the sustain electrodes.

Moreover, the projections of the transparent electrodes of the scan electrodes are different in dimension from those of the transparent electrodes of the sustain electrodes.

Furthermore, the projections are formed in plural.

In addition, the transparent electrodes are formed separately every discharge cell.

The first embodiment of the present invention will now be described in more detail with reference to the accompanying drawings.

Figure 1:
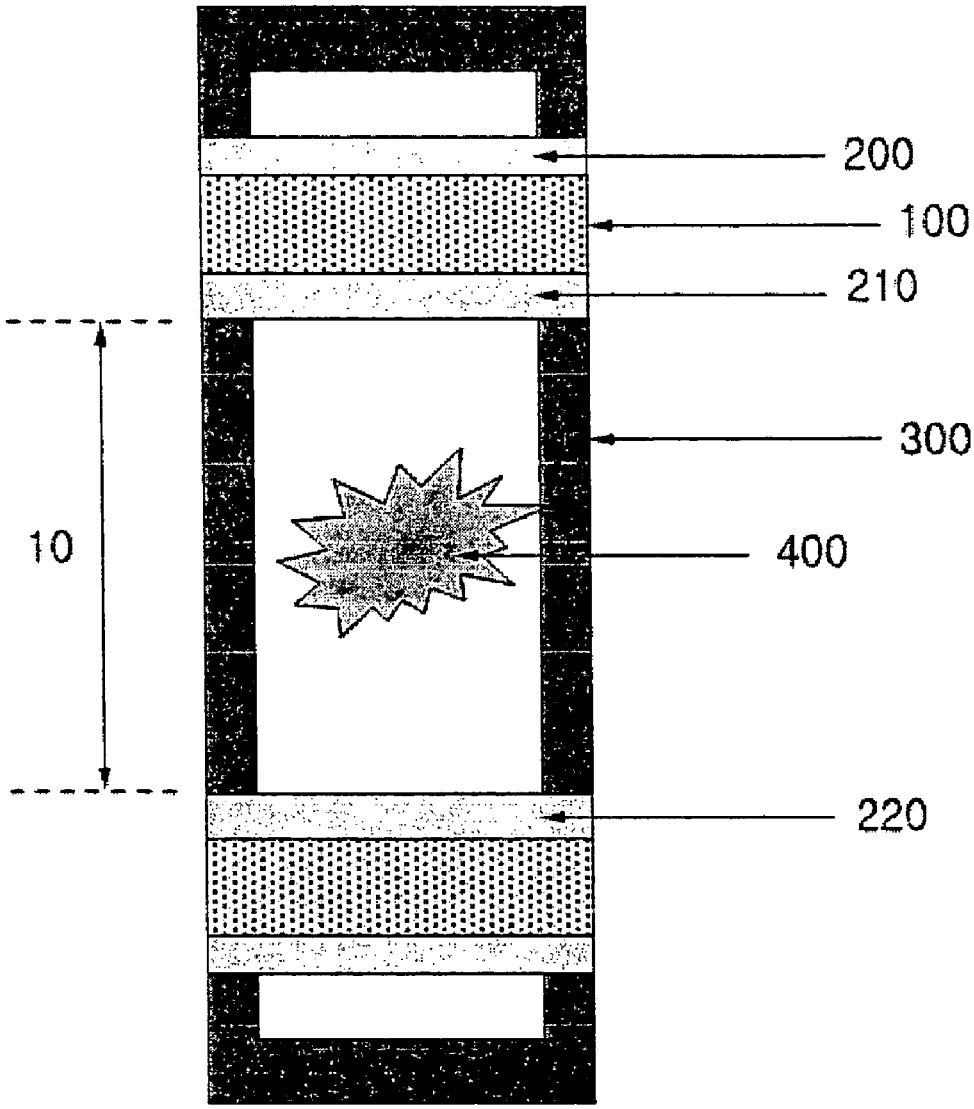
FIG. 1 shows an electrode structure of a front substrate in a conventional plasma display panel having a long column structure.
Figure 2:
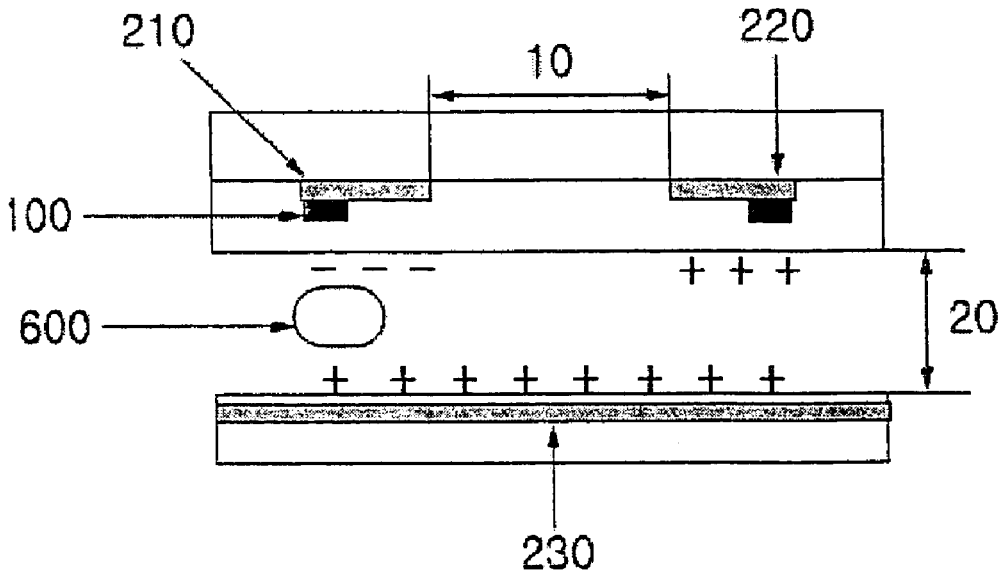
FIGS. 2, 3 and 4 are views shown to explain the principle of discharge start and discharge sustain in the plasma display panel of the long column structure.
Figure 3:
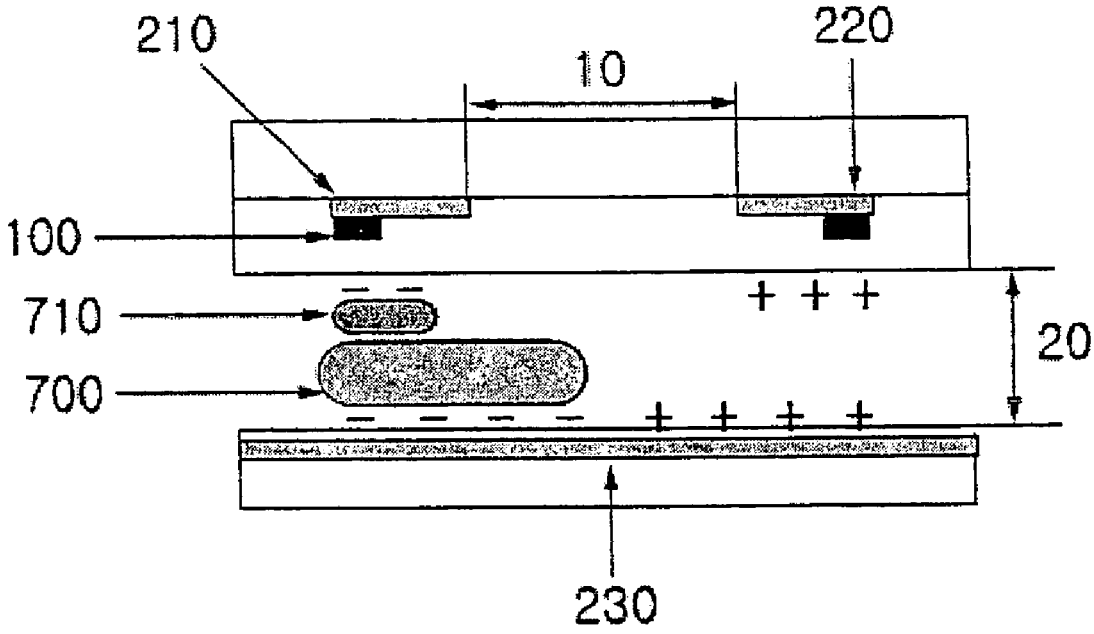
Figure 4:
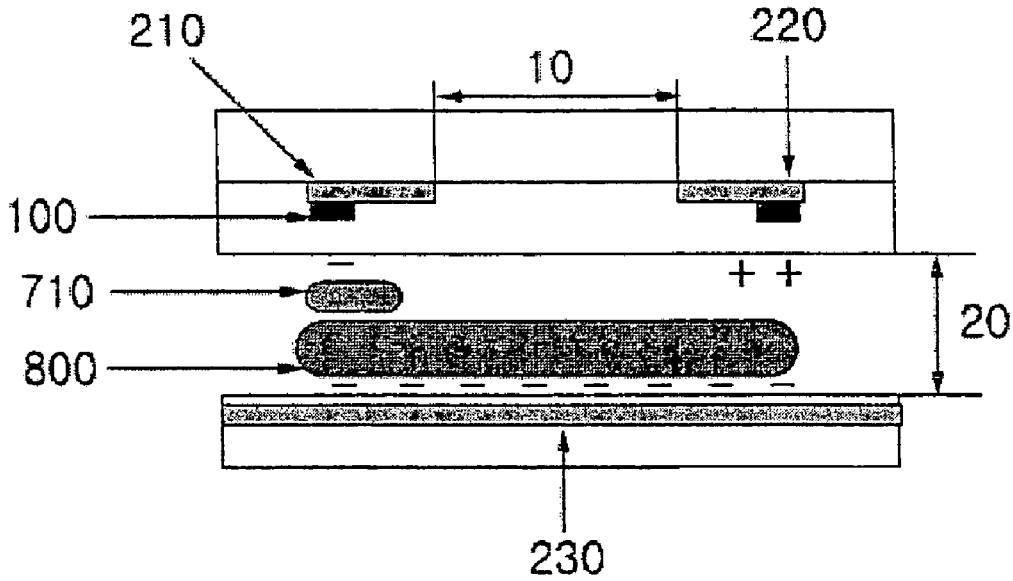
Figure 5:
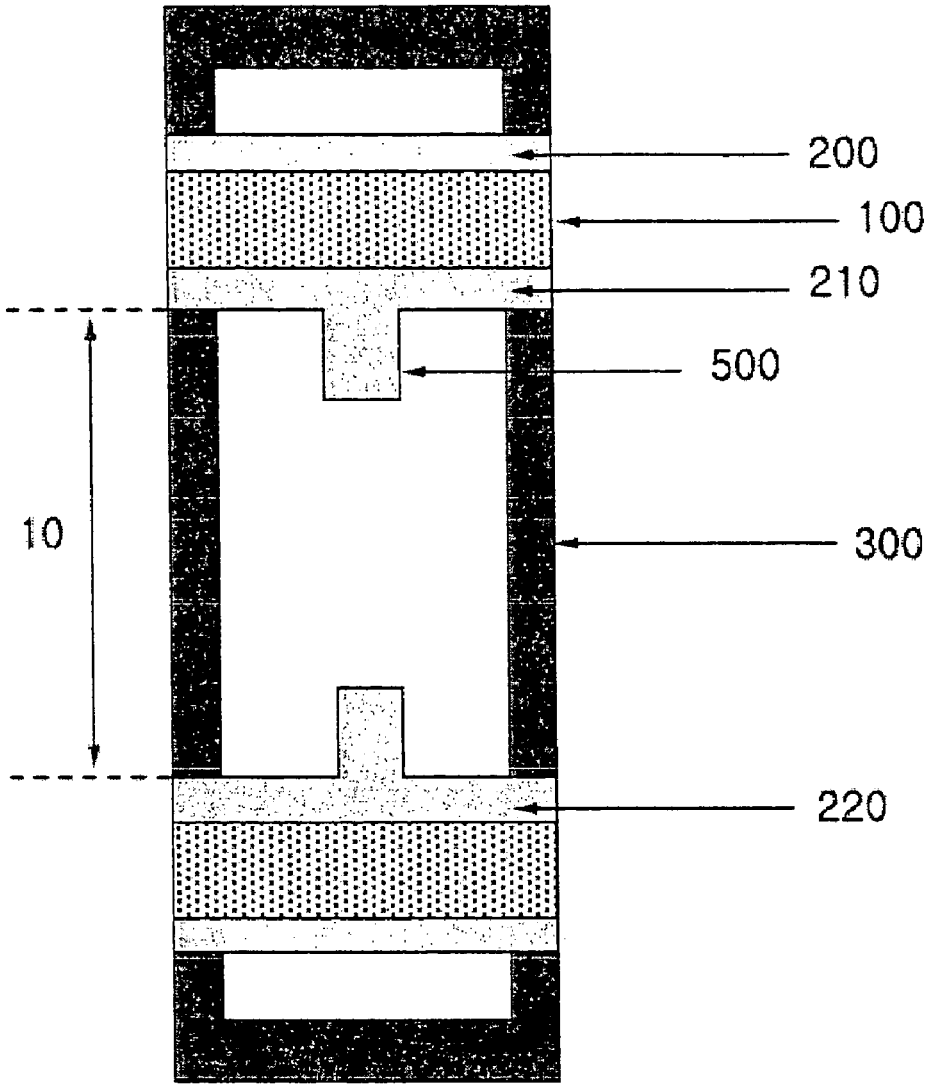
FIG. 5 is a plan view showing the electrode structure of a plasma display pane according to a first embodiment of the present invention.

FIG. 5 is a plan view showing the electrode structure of the plasma display pane according to the first embodiment of the present invention.

Referring to FIG. 5, the plasma display panel according to the first embodiment of the present invention has a long column structure. In this structure, in a state where a distance 10 between transparent electrodes 200 keeps 300 μm, the transparent electrodes 200 include projections 500 projected toward the center of a discharge cell. Thus, the distance 10 between the transparent electrodes 200 becomes far due to the existence of the projections 500. It can thus solve a problem that a discharge voltage increases. Resultantly, as increase in the discharge voltage is prevented while increasing brightness by means of the long column structure, driving efficiency is increased.

In FIG. 5, it has been shown that the projections are formed in all of the scan electrodes and the sustain electrodes. It is, however, to be noted that the projections can be formed only in the scan electrodes or the sustain electrodes. Thereby, desired brightness and driving efficiency are obtained.

Figure 6:
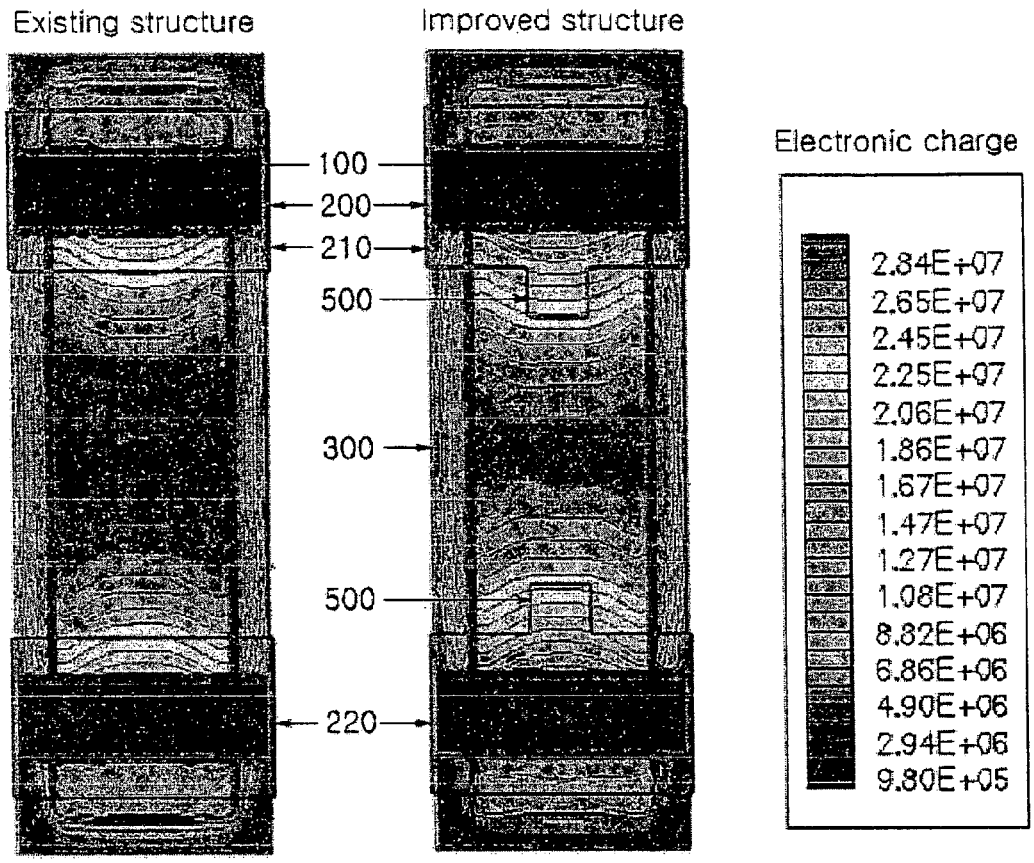
FIG. 6 shows a comparison result in distribution of an optical output between the conventional long column structure and the long column structure according to the first embodiment of the present invention.

FIG. 6 shows a comparison result in distribution of an optical output between the conventional long column structure and the long column structure according to the first embodiment of the present invention. The dimension of the projection 500 in the improved structure shown in FIG. 6 is 50 μm in width and 60 μm in length.

Referring to FIG. 6, in the existing structure, a distance between the transparent electrodes 200 is 300 μm or more. Thus, it can be seen that a discharge space between the two electrodes is wide. In the improved structure, however, it can be seen that the discharge space is narrow due to the existence of the projections 500. Accordingly, it is possible to lower a voltage when a discharge is initiated or maintained because the distance between the transparent electrodes is narrow.

Figures 7, 8:
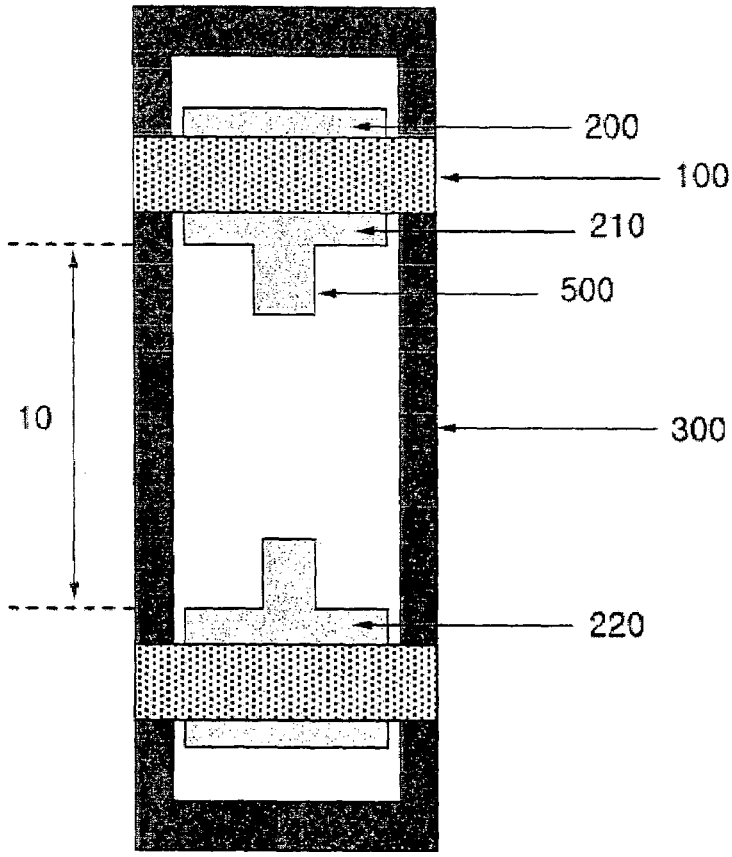
FIG. 7 is a table showing various discharge properties based on the result of FIG. 6.
FIG. 8 is a plan view showing the plasma display panel according to a modification example of the first embodiment of the present invention.

FIG. 7 is a table showing various discharge properties based on the result of FIG. 6. In FIG. 7, a numerical value within parentheses in the electrode structure indicates the dimension (μm×μm) of the electrode. The existing structure refers to a plasma display panel of a long column structure not having projections in transparent electrodes. The improved structure refers to a plasma display panel of a long column structure having projections in transparent electrodes.

From FIG. 7, it can be seen that the existing structure not having the projections has a discharge start voltage of 373.2V and brightness of 3533.4 cd/m$^2$. Meanwhile, an improved structure having projections of 80 um in length and 60 um in width has a discharge start voltage of 312.9V and brightness of 4014.1 cd/m$^2$. An improved structure having projections of 40 um in length and 60 um in width has a discharge start voltage of 344.0V and brightness of 3875.5 cd/m$^2$.

As a modification example of the first embodiment of the present invention, the shape of projections may be square, rectangular, triangular, etc. As the shape of the projections 500 can be modified into various shapes, it is possible to fabricate a panel using the projections 500 of a shape that is suitable to represent brightness wanted by a manufacturer of a plasma display panel. It is thus possible to lower a driving voltage since the projections 500 are provided.

Moreover, as another modification example of the first embodiment of the present invention, the shape and/or dimension of projections of transparent electrodes of a scan electrode and projections of transparent electrodes of a sustain electrode may be different. It is thus possible to implement projections having various shapes for obtaining desired brightness every electrode.

In addition, as still another modification example of the first embodiment of the present invention, the number of projections can be plural. Even in this case, the above-mentioned effects are obtained.

FIG. 8 is a plan view showing a plasma display panel according to a modification example of the first embodiment of the present invention. Referring to FIG. 8, the transparent electrodes 200 can be formed separately every discharge cell. It is thus possible to generate high brightness every cell. It is also possible to maintain desired brightness while further lowering a discharge start voltage and a discharge sustain voltage.

Second Embodiment

A plasma display panel according to a second embodiment of the present invention includes a front substrate and a rear substrate that are opposite to each other, wherein the plasma display panel includes scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, wherein a distance between the scan electrodes and the sustain electrodes is greater than that between the front substrate and the rear substrate, wherein the transparent electrodes of the scan electrodes or the sustain electrodes include projections projected toward the center of the discharge cells in at least one of the discharge cells, and the projections are different in shape from each other every red cell, green cell and blue cell.

Further, the projections have various shapes such as square, rectangle and triangle.

Also, the projections of the transparent electrodes of the scan electrodes are different in shape from those of the transparent electrodes of the sustain electrodes.

Moreover, the projections of the transparent electrodes of the scan electrodes are different in dimension from those of the transparent electrodes of the sustain electrodes.

Furthermore, the projections are formed in plural.

In addition, the transparent electrodes are formed separately every discharge cell.

The second embodiment of the present invention will now be described in detail with reference to the accompanying drawings.

Figure 9:
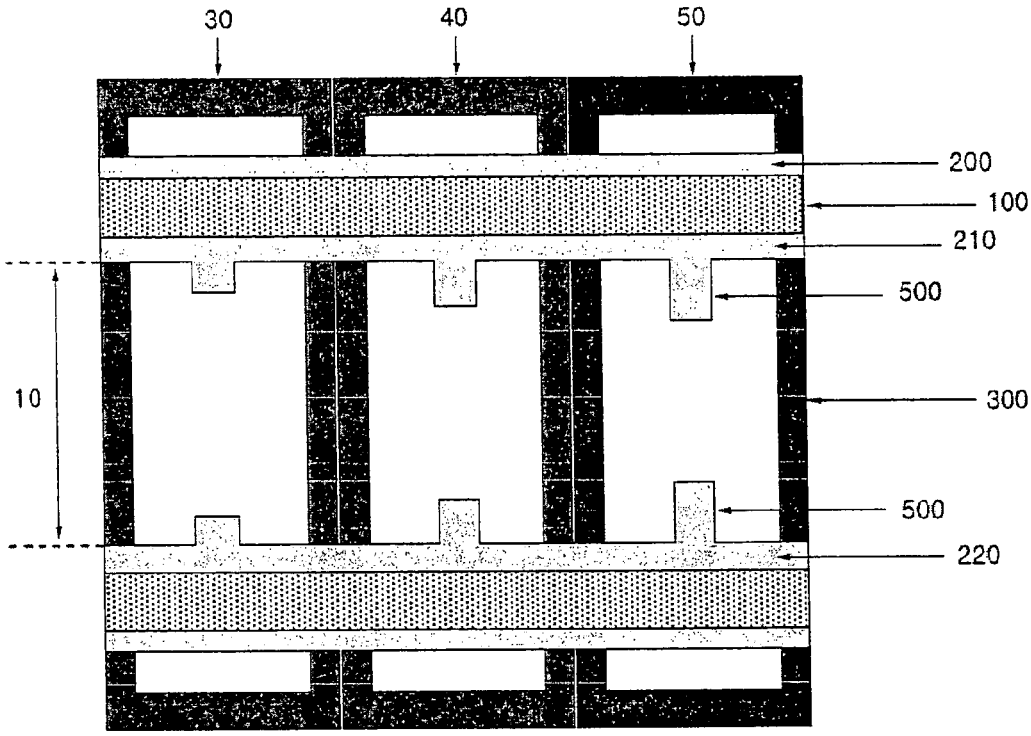
FIG. 9 is a plan view showing the electrode structure of a plasma display panel according to a second embodiment of the present invention.

FIG. 9 is a plan view showing the electrode structure of the plasma display panel according to the second embodiment of the present invention.

Referring to FIG. 9, the plasma display panel according to the second embodiment of the present invention has a long column structure. In this structure, in a state where a distance 10 between transparent electrodes 200 keeps 300 um or more, the transparent electrodes 200 include projections 500 projected toward a discharge space by a red cell 30, a green cell 40 and a blue cell 50. Further, the projections 500 have different shapes depending on the red cell 30, the green cell 40 and the blue cell 50.

As such, the projections 500 are included in the transparent electrodes 200. Thus, it can solve a problem that a discharge voltage increases because the distance 10 between the transparent electrodes 200 becomes far 300 um or more. Moreover, as the projections 500 that are different in shape from each other by the red cell 30, the green cell 40 and the blue cell 50 are provided, it is possible to construct the projections 500 of the transparent electrodes 200 of the red cell 30, the green cell 40 and the blue cell 50 variously, which are suitable to obtain discharge characteristic and efficiency wanted by a manufacturer of a plasma display panel.

Figure 10:
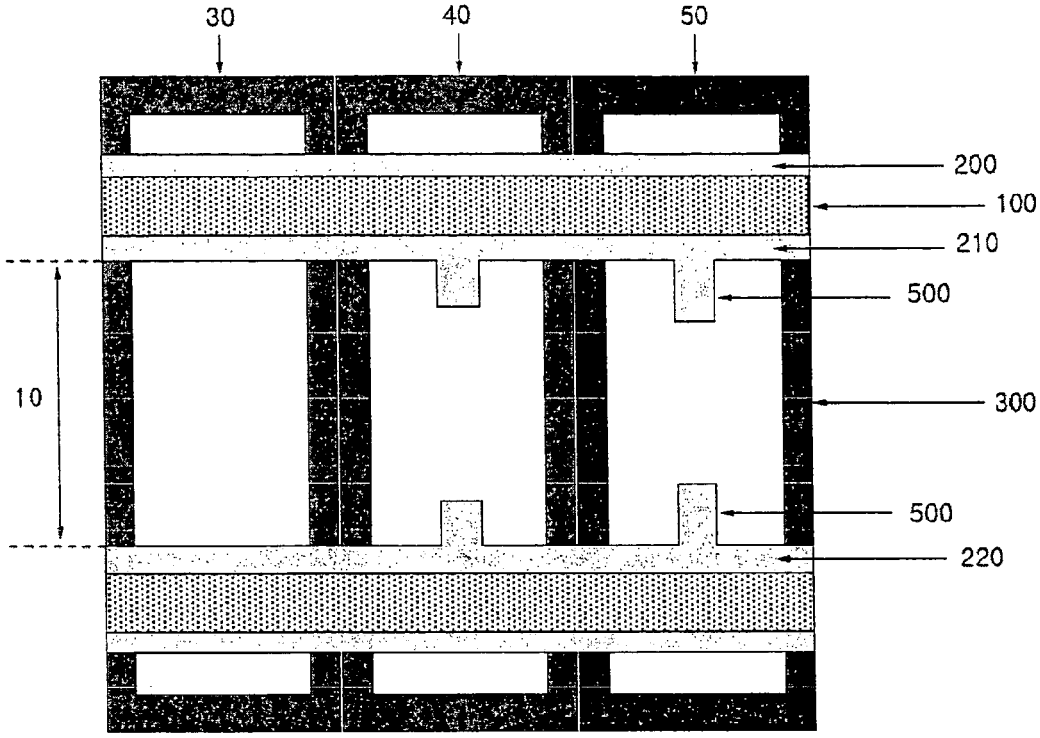
FIG. 10 is another plan view showing the electrode structure of a plasma display panel according to a modification example of the second embodiment of the present invention.

FIG. 10 is another plan view showing an electrode structure of a plasma display panel according to a modification example of the second embodiment of the present invention. Referring to FIG. 10, projections can be formed only in a predetermined one of RGB discharge cells. From FIG. 10, it can be seen that the projections 500 are not formed in the red cell 30 but only in the green cell 40 and the blue cell 50. Also, the projections 500 of the green cell 40 and the blue cell 50 are different in length.

Accordingly, in order to fabricate a plasma display panel having a discharge characteristic and driving efficiency desired by a manufacturer of a plasma display panel, it is required that the structure of the transparent electrodes 200 in each cell be changed variously.

Figure 11:
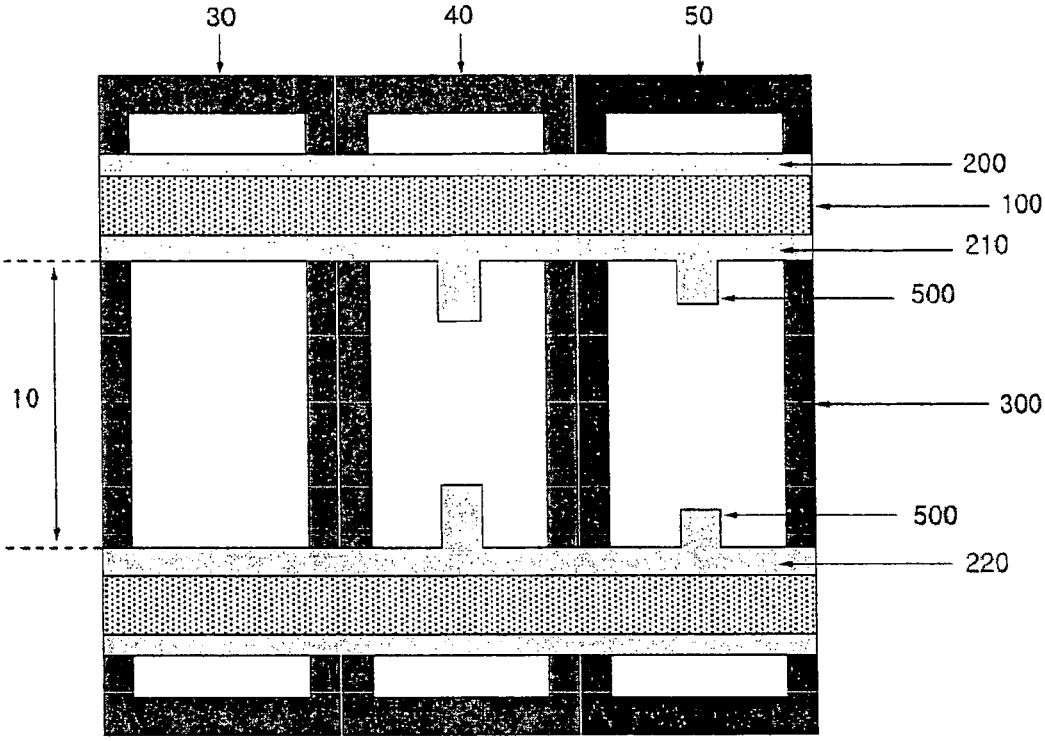
FIG. 11 is another plan view showing the electrode structure of a plasma display panel according to the second embodiment of the present invention.

FIG. 11 is another plan view showing the electrode structure of the plasma display panel according to the second embodiment of the present invention. Referring to FIG. 11, the length of the projections 500 of the green cell 40 is shorter than that of the projections 500 of the blue cell 50. The red cell 30 does not include the projections 500. This structure is for preventing an erroneous discharge occurring when a discharge voltage of the green cell 40 is increased in the plasma display panel of the long column structure in order to increase luminous brightness of the green cell 40 and making color temperature regular.

In this case, the discharge voltage for radiating the green cell 40 can become higher than that of the red cell 30 and the blue cell 50. Thus, it is possible to maintain an overall discharge voltage by making the length of the projections 500 of the green cell 40 the longest in order to lower the discharge voltage. As a constant discharge voltage is applied to each cell as such, an erroneous discharge can be reduced and driving efficiency can be increased when driving the panel. Moreover, although a constant discharge voltage is applied to each cell, there is an effect in that luminous brightness increases due to the long projection 500 of the green cell 40. Accordingly, overall brightness of the panel increases.

Therefore, the projections 500 that are different in shape from each other by the red cell 30, the green cell 40 and the blue cell 50 can be provided. Color temperature equilibrium of each of the cells can be controlled constantly using the shape of the projections. It is also possible to increase driving efficiency of a plasma display panel by minimizing the possibility of an erroneous discharge.

In addition, as another modification example of the second embodiment of the present invention, the shape and/or dimension of projections of transparent electrodes of a scan electrode and projections of transparent electrode of a sustain electrode can be different. It is thus possible to implement projections having various shapes in order to obtain desired brightness.

In addition, as still another modification example of the second embodiment of the present invention, the number of projections can be plural. Even in this case, the above-mentioned effects can be obtained.

Moreover, as still another modification example of the second embodiment of the present invention, the transparent electrodes 200 can be formed separately every discharge cell. Thus, high brightness can be generated every cell. It is also possible to maintain desired brightness while further lowering a discharge start voltage and a discharge sustain voltage.

Third Embodiment

A plasma display panel according to a third embodiment of the present invention includes a front substrate and a rear substrate that are opposite to each other, wherein the plasma display panel includes scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, wherein a distance between the scan electrodes and the sustain electrodes is greater than that between the front substrate and the rear substrate, wherein floating transparent electrodes are formed in the front substrate between the scan electrodes and the sustain electrodes.

Furthermore, the floating transparent electrodes are formed in pair every discharge cell, the pair of the floating transparent electrodes are arranged in a symmetrical manner to the center of the discharge cells, and a distance between the pair of the floating transparent electrodes is greater than that between the floating transparent electrode and the scan electrode or the sustain electrode.

In addition, the pair of the floating transparent electrodes is formed two or more in number every discharge cell.

The third embodiment of the present invention will now be described in more detail with reference to the accompanying drawings.

Figure 12:
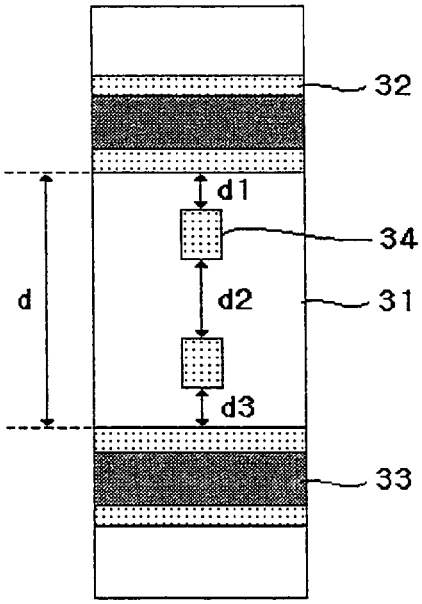
FIG. 12 is a plan view showing the electrode structure of a plasma display panel according to a third embodiment of the present invention.

FIG. 12 is a plan view showing the electrode structure of the plasma display panel according to the third embodiment of the present invention.

Referring to FIG. 12, floating electrodes 34 that are electrically isolated are formed in pair using transparent ITO between transparent electrodes 32 that are formed on an upper plate glass substrate 31 with a sufficient distance d intervened between the electrodes 32. There is no reduction in brightness since the floating electrodes 34 are formed using transparent electrodes. The construction is very simple because the floating electrodes 34 are not connected to additional electrodes.

The transparent electrodes 32 and bus electrodes 33 are scan electrodes and sustain electrodes, respectively. In this embodiment, the transparent electrodes 32 and the bus electrodes 33 are formed in a symmetrical manner. Thus, they can be changed in their locations. The transparent floating electrodes 34 that are newly added in this embodiment are spaced from the transparent electrodes 32 and are disposed adjacent to the transparent electrodes 32, respectively. Distances d1 and d3 between the transparent floating electrodes 34 and the transparent electrodes 32 are constructed so that they are the same. However, it is preferred that a distance d2 between the respective transparent floating electrodes 34 is longer than the distances d1 and d3 between the transparent electrodes 32 and the transparent floating electrodes 34. That is, it is preferable that d1=d3 and d2>d1=d3 for the best efficiency.

The transparent floating electrodes 34 are accumulated with electrical charges simultaneously when the transparent electrodes 32 and lower plate address electrodes (not shown) are accumulated with electrical charges during the reset period and the address period. Thereafter, if a weak discharge is diffused between the scan electrodes and the address electrodes during the sustain period, the charges accumulated in the floating transparent electrodes 34 help electrons to diffuse. Therefore, there are effects in that a lower discharge voltage can be used and brightness and efficiency are also improved.

Figure 13:
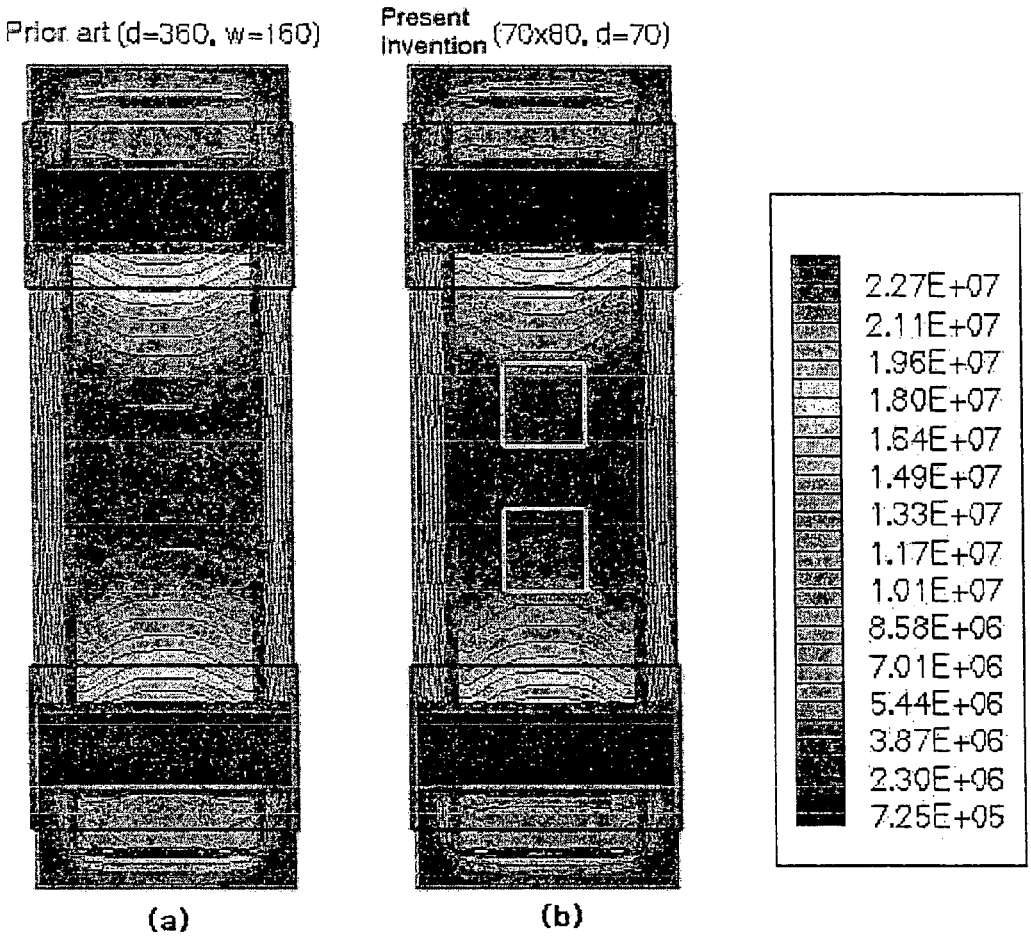
FIG. 13 shows a simulation result in distribution of optical outputs between the electrode structure of the third embodiment of the present invention shown in FIG. 12 and a conventional structure having transparent floating electrodes not formed therein.

FIG. 13 shows a simulation result in distribution of optical outputs between the electrode structure of the third embodiment of the present invention shown in FIG. 12 and a conventional structure having transparent floating electrodes not formed therein. A distance between the transparent electrodes in both the structure of the third embodiment and the conventional structure is 360 μm. In the third embodiment, the dimension of the transparent floating electrode is 70 μm×80 μm. In addition, a distance between transparent floating electrodes is 70 μm.

From FIG. 13, it can be seen that a region having the strongest optical output is located at the center widely in the third embodiment of the present invention, and brightness and efficiency have increased from the fact that the dimension of the region having the strongest optical output becomes wider than that of the conventional long column (LC) structure.

TABLE 1

| Electrode Structure | Discharge Efficiency (%) | Luminous Efficiency (lm/W) | Brightness (cd/m2) | Maximum Optical Output (#) | Maximum Current (mA) |
|---|---|---|---|---|---|
| Existing Structure | 24.7 | 2.32 | 3533.4 | 6.45E+07 | 0.501 |
| Improved Structure (80 × 60) | 25.1 | 2.34 | 3572.2 | 6.54E+07 | 0.499 |
| Improved structure (70 × 80) | 25.0 | 2.34 | 3569.2 | 6.53E+07 | 0.492 |
| Improved structure (40 × 60) | 24.9 | 2.35 | 3590.9 | 6.70E+07 | 0.530 |

From Table 1, it can be seen that a structure into which two transparent floating electrodes are inserted has improved brightness and efficiency characteristics compared to an existing structure as in the third embodiment of the present invention. It can be also seen that higher efficiency can be obtained by setting the area of transparent floating electrodes depending on a structure to be applied. It will also know that brightness and efficiency increased when then transparent floating electrodes are formed between the transparent electrodes even in a structure of any size.

Figure 14:
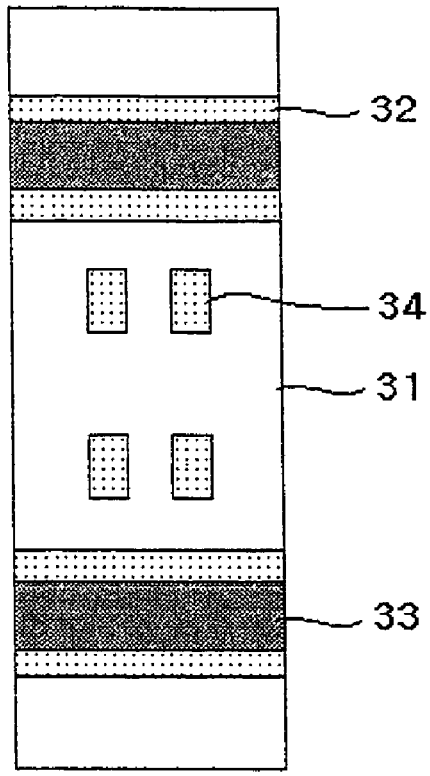
FIG. 14 and FIG. 15 show an electrode structure of a plasma display panel according to a modification example of the present invention.
Figure 15:
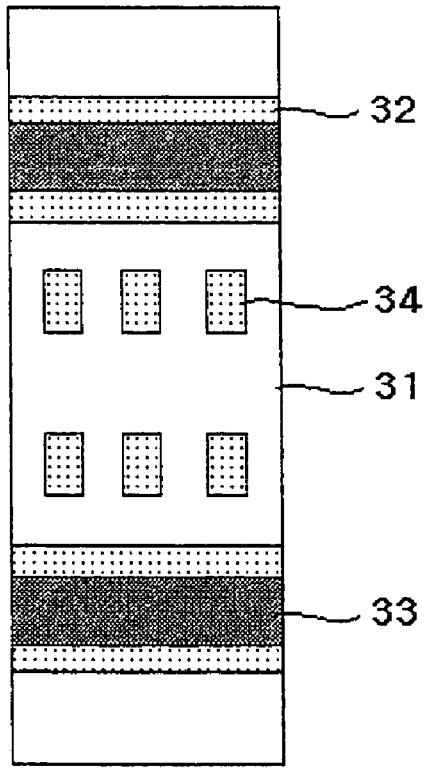

FIGS. 14 and 15 show the electrode structure of a plasma display panel according to a modification example of the present invention.

FIG. 14 shows the electrode structure in which the transparent floating electrodes 34 are divided in the structure shown in FIG. 12. In FIG. 14, distances between the transparent floating electrodes 34 and neighboring transparent electrode 32 are the same. That is, the transparent floating electrodes 34 can be arranged while one or more transparent floating electrodes are spaced from the transparent electrodes by the same distance. It is preferred that the transparent floating electrodes 34 are disposed symmetrically around the central point between the transparent electrodes 32. In other words, in this case, if the distances between the transparent floating electrodes 34 and neighboring transparent electrodes 32 are the same, which is called d1, and the distance between the transparent floating electrodes 34 that are symmetrical is d2, the transparent floating electrodes 34 the transparent electrodes 32 adjacent to them are arranged so that d2>d1.

FIG. 15 shows the electrode structure for forming the transparent floating electrodes 34 without arrangement. In FIG. 15, the transparent floating electrodes 34 are arranged uniformly over the entire upper plate of a device so that they are adjacent to the transparent electrodes 32 by the same isolation distance between the transparent electrodes 32 that are formed over the entire upper plate by means of buses. This structure allows the present invention to be applied more easily.

As described above, transparent floating electrodes that are not connected to electrodes are arranged adjacent to transparent electrodes such that they are symmetrical to a single cell without additional electrodes or a complex structural change. It is therefore possible to lower a high discharge voltage and to increase brightness and efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel of a long column structure having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein the transparent electrodes of the scan electrodes or the sustain electrodes include projections projected toward the center of the discharge cells every discharge cell.

2. The plasma display panel as claimed in claim 1, wherein the projections have various shapes such as square, rectangle and triangle.

3. The plasma display panel as claimed in claim 1, wherein the projections of the transparent electrodes of the scan electrodes are different in shape from those of the transparent electrodes of the sustain electrodes.

4. The plasma display panel as claimed in claim 1, wherein the projections of the transparent electrodes of the scan electrodes are different in dimension from those of the transparent electrodes of the sustain electrodes.

5. The plasma display panel as claimed in claim 1, wherein the projections are formed in plural.

6. The plasma display panel as claimed in claim 1, wherein the transparent electrodes are formed separately every discharge cell.

7. A plasma display panel of a long column structure having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein the transparent electrodes of the scan electrodes or the sustain electrodes include projections projected toward the center of the discharge cells in at least one of the discharge cells, and the projections are different in dimension from each other every red cell, green cell and blue cell.

8. The plasma display panel as claimed in claim 7, wherein the projections have various shapes such as square, rectangle and triangle.

9. The plasma display panel as claimed in claim 7, wherein the projections of the transparent electrodes of the scan electrodes are different in shape from those of the transparent electrodes of the sustain electrodes.

10. The plasma display panel as claimed in claim 7, wherein the projections of the transparent electrodes of the scan electrodes are different in dimension from those of the transparent electrodes of the sustain electrodes.

11. The plasma display panel as claimed in claim 7, wherein the projections are formed in plural.

12. The plasma display panel as claimed in claim 7, wherein the transparent electrodes are formed separately every discharge cell.

13. A plasma display panel of a long column structure having a front substrate and a rear substrate that are opposite to each other, the plasma display panel including scan electrodes and sustain electrodes that are spaced apart from each other in parallel on the opposite surface of the front substrate and have transparent electrodes and metal electrodes, respectively, a dielectric layer that covers the scan electrodes and the sustain electrodes, a protection film coated on the dielectric layer, address electrodes formed on the opposite surface of the rear substrate, a dielectric layer that covers the address electrodes, barrier ribs formed on the dielectric layer, discharge cells demarcated by the barrier ribs, and a phosphor layer coated on the inside of the discharge cells, a distance between the scan electrodes and the sustain electrodes being greater than that between the front substrate and the rear substrate, wherein floating transparent electrodes are formed in the front substrate between the scan electrodes and the sustain electrodes.

14. The plasma display panel as claimed in claim 13, wherein the floating transparent electrodes are formed in pair every discharge cell, the pair of the floating transparent electrodes are arranged in a symmetrical manner to the center of the discharge cells, and a distance between the pair of the floating transparent electrodes is greater than that between the floating transparent electrode and the scan electrode or the sustain electrode.

15. The plasma display panel as claimed in claim 14, wherein the pair of the floating transparent electrodes is formed two or more in number every discharge cell.

* * * * *